US010743652B2

(12) United States Patent
Eimann et al.

(10) Patent No.: US 10,743,652 B2
(45) Date of Patent: Aug. 18, 2020

(54) DEVICE FOR PROVIDING BRISTLES FOR BRUSH PRODUCTION AND PROVIDING METHOD

(71) Applicant: The Procter & Gamble Company, Cincinnati, OH (US)

(72) Inventors: Klaus Eimann, Zellingen (DE); Marko Schaeffer, Birkenfeld (DE)

(73) Assignee: The Procter & Gamble Company, Cincinnati, OH (US)

( * ) Notice: Subject to any disclaimer, the term of this patent is extended or adjusted under 35 U.S.C. 154(b) by 789 days.

(21) Appl. No.: 14/600,535

(22) Filed: Jan. 20, 2015

(65) Prior Publication Data

US 2015/0216295 A1 Aug. 6, 2015

(30) Foreign Application Priority Data

Feb. 6, 2014 (EP) ..... 14154120

(51) Int. Cl.
*A46D 1/04* (2006.01)
*A46D 3/08* (2006.01)
*A46D 3/04* (2006.01)

(52) U.S. Cl.
CPC ..... *A46D 3/082* (2013.01); *A46D 3/04* (2013.01)

(58) Field of Classification Search
CPC ..... A46D 3/082; A46D 3/042; A46D 3/06; A46D 3/045; A46D 3/04; A46D 3/00; A46D 1/04; A46D 1/08
USPC ..... 300/5–8, 10, 11
See application file for complete search history.

(56) References Cited

U.S. PATENT DOCUMENTS 2,017,845 A * 10/1935 Alexander ..... A46D 3/04 300/21
2,035,709 A * 3/1936 Laub ..... A46D 3/04 300/4
2012/0013169 A1 1/2012 Rees
2013/0038115 A1* 2/2013 Stein ..... A46D 3/045 300/2

FOREIGN PATENT DOCUMENTS

WO WO 2011/126020 A1 10/2011

OTHER PUBLICATIONS

CM4036Q International Search and Written Opinion for PCT/US2015/012421 dated Mar. 27, 2015.

* cited by examiner

*Primary Examiner* — Joseph J Hail
*Assistant Examiner* — Shantese L McDonald
(74) *Attorney, Agent, or Firm* — Parker D. McCrary; Vladimir Vitenberg

(57) ABSTRACT

A method for providing bristles for automated production of brushes, in particular toothbrushes or parts thereof may comprise providing a plurality of bristles in a storage container, applying oil to at least a part of the plurality of bristles in the storage container, separating a bristle tuft from the storage and transporting the bristle tuft in a tube using an airflow. The plurality of bristles tufts can be transferred to a providing unit, in which the bristles tufts are arranged in a pre-defined tuft pattern and may be over-molded by injection molding in order to form at least a brush head. A device suitable to perform the method comprises at least an immersion unit to apply oil to bristles and an airflow-using transportation unit.

9 Claims, 2 Drawing Sheets

DEVICE FOR PROVIDING BRISTLES FOR BRUSH PRODUCTION AND PROVIDING METHOD

FIELD OF THE INVENTION

There is provided a method for providing bristles for automated production of brushes, in particular toothbrushes. The method comprises in particular the preparation of the bristles including application of oil to the bristles and the subsequent transport via airflow to a brush forming device. In addition, there is provided a device for providing the bristles including an immersion unit which transfers oil to the bristles and a transportation unit using airflow.

BACKGROUND OF THE INVENTION

Toothbrushes, in particular of manual toothbrushes, are constructed as disposable articles. Latest after three month of use a manual toothbrush shall be replaced at least due to hygienic reasons. That means that consumer generally only expect a low pricing for manual toothbrushes. On the other hand, manual toothbrushes have to meet a lot of requirements, such as complex bristle fields in order to clean properly interdentally, the gum line as well as the back molar teeth. Further, a manual toothbrush has to be smooth to the gum and comfortable to handle. Thus, there is a continuous need for the manufacturer of manual toothbrushes to optimize production processes in order to work very cost effective. One problem of the manufacturing of manual toothbrushes is the production time. Speed reducing steps are the cooling times needed if injection molding is used and the complexity of the bristle fields. The latter requires a lot of successive steps, if anchor technology is used to fasten the bristle filaments to the brush head. In contrast, anchor-free bristling technologies further improve the complexity of the molding procedure which as a consequence increases the molding time. That means a continuous need exist to optimize automated production of toothbrushes in order to produce toothbrushes with high and standardized quality at low costs.

Nowadays, productivity as well as machine performance and machine output, in particular outside the molding steps, may be suitable approaches to reduce costs. To improve flexibility and machine performance bristle providing tools were developed using airflow systems to transport bristles or bristle tufts (WO 2011/128020). Thereby, bristle tufts are picked from storage and transported via vacuum sucking through flexible plastic tubes. However, the transport via flexible tubes is operationally not reliable enough for high output numbers. Additionally these systems also show problems with dust accumulation and distribution. Thus, it is the object of the present application to provide an improved automated bristle providing device which can be combined with airflow transport system and shows a high operational reliability.

SUMMARY OF THE INVENTION

In accordance with one aspect, there is provided a method of providing bristles for automated production of brushes, in particular toothbrushes or parts thereof, comprising

- providing a plurality of bristles in a storage container;
- applying oil to at least a part of the plurality of bristles in the storage container;
- separating two or more bristles from the bristles to which the oil was applied in order to form a bristle tuft;

- transporting at least one of the separated bristle tufts in a tube using an airflow; and
- arranging the at least one bristle tufts in a pattern intended to form a bristle pattern of the brush to be produced.

In accordance with another aspect, there is provided a device for providing bristles for the automated production of brushes, in particular toothbrushes, comprising

- a storage container comprising a plurality of bristles located therein, wherein the storage container comprises at least one open side and a bottom side opposite to the open side and wherein the bristles are arranged in such that a first end of the bristles is located at the bottom side of the storage container and a second end of the bristles is located in the direction of the open side of the storage container;
- an immersion unit suitable to apply oil to at least a part of the plurality of bristles stored;
- a separation unit suitable to separate bristles from the storage container, wherein the separated bristles form a bristle tufts;
- a transportation unit suitable to transport the bristle tufts, wherein the transportation unit comprises at least one tube and a device for producing an airflow inside the at least one tube; and
- an arranging unit in which the bristle tufts are collected and arranged in a pre-determined pattern after the transportation, wherein the at least one tube of the transportation unit connects the separation unit with the arranging unit; and
- a providing unit which provides the pattern of the bristle tuft to a brush forming unit suitable to form a brush.

BRIEF DESCRIPTION OF DRAWINGS

These and other features will become apparent not only from the claims but also from the following description and the drawings, with the aid of which example embodiments are explained below.

DETAILED DESCRIPTION OF THE INVENTION

Figure 1:
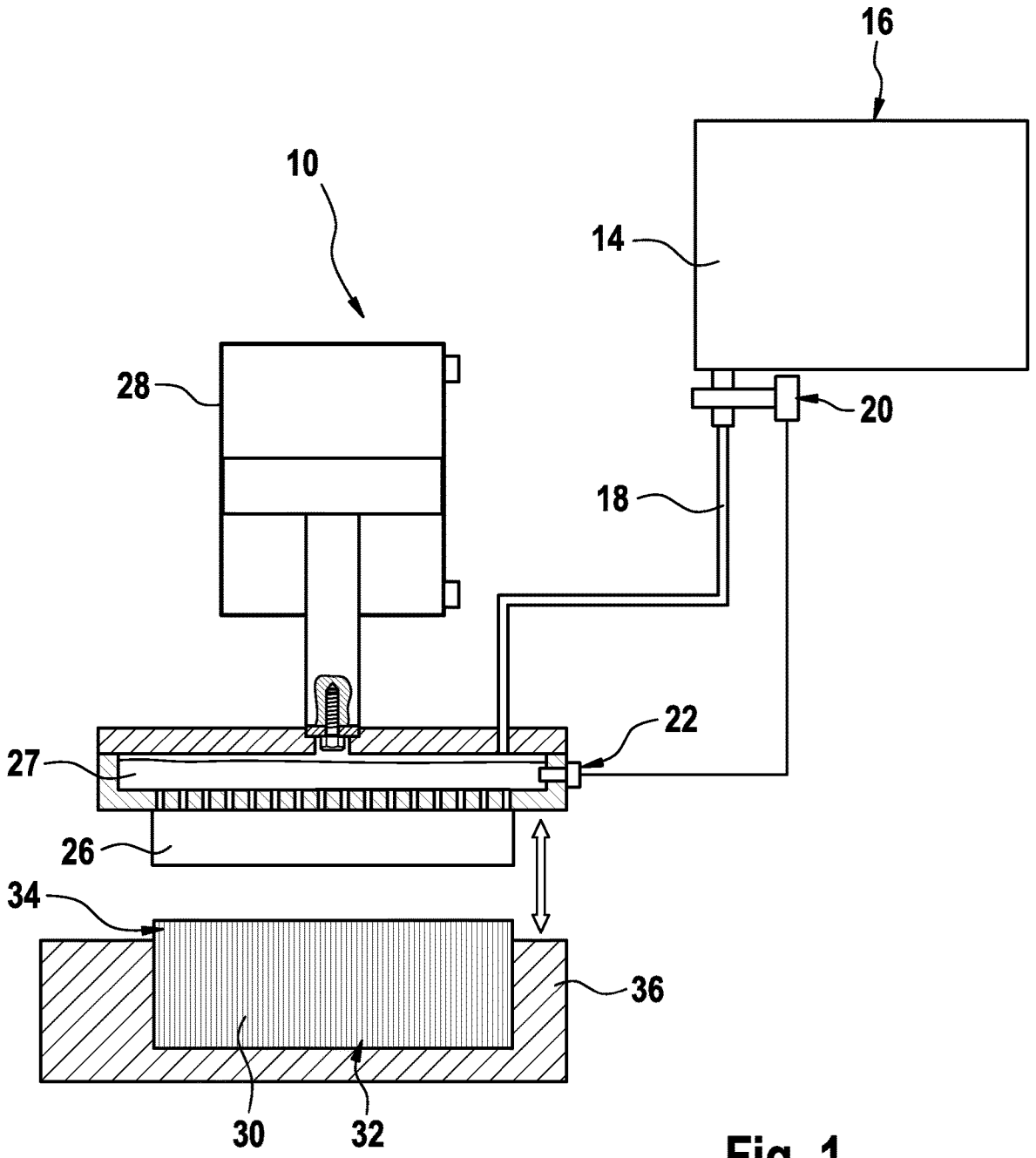
FIG. 1 shows a schematic sketch of an immersion unit 10 suitable to apply oil 14 to a plurality of bristles 30.

The following is a description of numerous versions of a method to provide bristles for brush production, in particular for toothbrush production. The description further discloses a device which can be used to produce (tooth)brushes, in particular by using the disclosed method. The description is to be construed as exemplary only and does not describe every possible embodiment since describing every possible embodiment would be impractical, if not impossible, and it will be understood that any feature, characteristic, structure, component, step or methodology described herein can be deleted, combined with or substituted for, in whole or in part, any other feature, characteristic, structure, component, product step or methodology described herein. In addition, single features or (sub)combinations of features may have inventive character irrespective of the feature combination provided by the claims, the respective part of the specification or the drawings.

Further, detailed description of individual features as well as definitions and further specifications are disclosed with respect to both the method as well as the device, irrespectively of the respective part of the specification belongs primary to the method or the device.

There is provided a method providing bristles for the production of brushes, in particular toothbrushes or parts thereof. The method disclosed relates at least to the steps of providing a plurality of bristles in a storage container, separating two or more bristles from the plurality of bristles arranged in the storage container thereby forming a bristle tuft, transporting the separated bristle tufts using an airflow system and arranging the bristles in a pattern to be included into the brush to be produced. Said airflow system comprises tubes in which the airflow is produced. A positive or negative airflow might be used. I.e. the bristles might be transported by blowing or sucking, in particular the bristles are transported by vacuum sucking.

In addition, the bristles are treated with oil, when they are stored in the container. That means, the method comprises in addition the step of applying oil to at least a part of the plurality of bristles in the storage container. Surprisingly, it was found that the intermediate oil treatment of the bristles improves the device performance of the corresponding bristle providing device dramatically. In particular, the transport by airflow in tubes requires that the bristles do not stick to each other or the tube walls and that they do not crimp during the transport so that the parallel arrangement remains Immersion with oil before the transport avoids accumulation in the tubes thereby improving the performance and reliability of the transportation unit. In addition, the dust in the whole providing system is reduced which is advantageous regarding the final brushes as well as also improves lifetime of the devices and process reliability.

The step of applying the oil to at least a part of the plurality of bristles in the storage container may comprise the steps of providing an absorbent and immersing the absorbent with the oil. Suitable oils according to the present disclosure are oils which are allowed to come into contact with the human body, in particular with the human oral cavity, and might be swallowed without any negative effects to the human body. Synthetic oils as well as natural oils may meet said requirement. All edible natural oils can be used as well as synthetic oils certified for use in medical and/or cosmetic application. A list of certified synthetic oils is for example provided by the Food and Drug Administration (FDA). Synthetic oils which can be used herein are for example mineral or technical oil, in particular silicone oils. A suitable silicone oil may be for example a 35% dimethicone NF emulsion of DOW CORNING (trade name DOW CORNING 365), being a white liquid emulsion containing 35% Dow Cornings 360 medical Fluid. An exemplary embodiment for providing an absorbent and immersing it with the oil to be used is disclosed in detail below together with the immersion unit.

After the absorbent has been immersed with the oil at least a part of the plurality of bristles is brought into contact with the immersed absorbent thereby transferring oil from the absorbent to the bristles. The number of the bristles immersed with the oil in one transfer step depends on the dimension and shape of the absorbent. Due to geometric reasons it might be advantageous to contact only a part of the bristles during each immersion step. Alternatively, all bristles stored in the container are contacted with the absorbent during each immersion step. If all bristles are contacted the absorbent can additionally apply pressure to the bristles so that they are located completely at the bottom of the storage container. In addition, contact time of the absorbent with the bristles can be reduced as during storage time of an individual bristle in the container the bristles are immersed more than once with the oil from the absorber.

The oil may be applied by gravity and/or capillary forces. The bristles are stored in the container with parallel length axes, wherein one bristle end is exposed to the environment via an open side of the container and the other end is located at the bottom of the container. The oil is applied by contacting the absorber with the end of the bristles being exposed using a predefined contact time and a predefined contact pressure and rinsing along the length axis of the bristle. Due to the tight arrangement of the bristles in the storage container strong capillary forces are produced which are strong enough to apply the oil without the help of gravity or even against gravity. A suitable period of time sufficient to apply the oil to the bristle ends may be in the range from about 0.1 sec to about 5 sec, in particular in the range from about 0.5 sec to about 3 sec, more particular in the range of about 1 sec to about 2 sec or any other numerical range which is narrower and which falls within such broader numerical range, as if such narrower numerical ranges were all expressly written herein. In addition or alternatively, the application of the oil may be controlled by a sensor. For example at the bottom of the storage container a sensor might be arranged monitoring the immersion state of the bristle end located therein.

Thereby the oil is transferred to a larger amount of bristles in one application step. For example an amount of oil being in the range from about 0.1 g to about 2 g, in particular in the range from about 0.5 g to about 1.5 g, more particular in the range of about 0.7 g to about 1.2 g or any other numerical range which is narrower and which falls within such broader numerical range, as if such narrower numerical ranges were all expressly written herein may be transferred to about 120000 filaments. Thereby, the amount of oil applied to the individual bristle may differ slightly due to an inhomogeneous distribution. For example, the amount of oil applied to an individual bristle may be measured e.g. using Fourier-Transform-Infrared Spectrometrie (FTIR). Using the application scheme as disclosed herein the individual bristle comprises oil in the range from about 100 ppm to about 250 ppm, in particular, the range from about 120 ppm to about 200 ppm, more particular in the range from about 150 ppm to about 180 ppm oil or any other numerical range which is narrower and which falls within such broader numerical range, as if such narrower numerical ranges were all expressly written herein.

Bristles may be for example monofilaments made from plastic material. Suitable plastic material used for bristles may be polyamide (PA), in particular nylon, polybutylterephthalate (PBT), polyethylterephthalate (PET) or mixtures thereof. In addition, the bristle material may comprise additives such as abrasives, color pigments, flavours etc. For example an abrasive such as kaolin clay may be added and/or the filaments may be colored at the outer surface in order to realize indicator material. The coloring on the outside of the material is slowly worn away as the filament is used over time to indicate the extent to which the filament is worn. The optional additive may also be added during the method as disclosed herein. For example, additives which are applied to the surface of the bristles may be added to the oil which is applied. Thus, the additive is applied together with the oil and rests at the surface. Suitable additives which can be added to the oil to be applied are for example UV-brighteners, signaling substances, such as the indicator color pigments and/or abrasives.

Before the oil is applied to the bristles the bristles might be pre-treated. Pre-treatment might be for example end rounding of one end of the bristles. End-rounding means a cascade of grinding and polishing steps so that the end which is sharp after cutting of a bristle filament comprises a round, dome-shaped and smooth surface. End-rounded ends are intended to be the cleaning ends of a bristle, namely the ends coming into contact with the oral cavity and the tissues located therein. End-rounding may be for example performed before the bristles are cut into the length in which they are stored in the storage container. For example, bristle filament strands are available as hanks. A bristle hank is an arrangement of a plurality, namely about 120000, bristle filaments which are all arranged with parallel length axis. The diameter of a hank is defined by the diameter and number of the bristles forming one hank. The length of the hank depends on handling requirements. It might be advantageous to end-round the bristle ends of the hank and then cut off a slice of a predefined length. Such a slice, called a puk, comprises bristles in a predefined length. If the bristle ends of the hank were end-rounded before the puk was cut, the bristles located in the puk comprise one end which is end-rounded and one sharp end. In addition or alternatively, the puk might be cut off the hank first and might be end-rounded after cutting.

The oil might be applied to the bristle from both ends, the sharp end and the end-rounded end. Application from the end-rounded end is advantageous as the oil distribution is slightly increased compared to the sharp end, but application from the sharp end might be advantageous as well. If the oil is applied from the sharp ends, the end-rounded ends are located at the bottom of the storage container and are covered thereby during the process. For example, the end-rounded ends do not come into contact with the immersion unit applying potentially dust together with the oil. In addition, in the latter arrangement the bristles enter and leave the tube of the transportation unit with the sharp ends as well. In particular, if the bristles bump against a stopper plate at the end of the tube of the transportation unit said mechanical influence might alter the shape of the bristles which is not desired for the end-rounded ends.

An additional pre-treatment step may be a drying step. The drying step may be performed before or after the end-rounding step. For example, the hank may be dried or the individual puks may be dried or the bristles might be already stored in the storage container and are dried therein. Drying before the end-rounding may be preferred as the wear debris produced during the grinding and polishing does not stick to a dried bristles surface. That means, if the bristles are dried before the end-rounding step cleaner bristles can be used for the following steps. Depending on the end-rounding the bristles are therefore in particular dried as a hank. Drying might take place in a drying oven or using a microwave. In particular microwave drying might be advantageous due to shorter application times. For example, a hank may be treated in a microwave with a power in a range from about 500 W to about 900 W, in particular in a range from about 550 W to about 800 W more particular in a range from about 600 W to about 700 W or any other numerical range which is narrower and which falls within such broader numerical range, as if such narrower numerical ranges were all expressly written herein. The treatment may be for about 2 to about 15 min, in particular for about 4 to about 12 min, more particular for about 6 to about 10 min or any other numerical range which is narrower and which falls within such broader numerical range, as if such narrower numerical ranges were all expressly written herein.

After the oil has been applied to the bristles, a predefined number of bristles is separated from the storage container Said pre-defined number correspond to the number of bristles usually used for one bristle tuft. Suitable numbers of bristles to form one bristle tuft may be for example in the range of about 10 to about 80, or in the range of about 15 to about 60, or in the range of about 20 to about 50, or in the range of about 25 to about 40, or any other numerical range which is narrower and which falls within such broader numerical range, as if such narrower numerical ranges were all expressly written herein. Picking devices for said separation step are widely known from the prior art.

The separated bristle tufts are then transported in a tube via airflow to an arranging unit. In the arranging unit the bristle tufts are arranged in a pre-defined pattern intended to form a bristle pattern of the brush to be produced. The arrange bristle pattern may be introduced into a molding machine and a brush head may be formed by injection molding including over-molding of the bristle tuft pattern.

In addition or alternatively, there is also provided a device for providing bristles for the automated production of brushes, in particular toothbrushes. Said device comprises a storage container comprising a plurality of bristles located therein. Bristles may be for example monofilaments made from plastic material, such polyamide (PA), polybutylterephthalate (PBT), polyethylterephthalate (PET) or mixtures thereof. The diameter of the bristle filament may be in the range from about 0.01 mm to about 0.3 mm, in particular in the range from about 0.05 to about 0.2 mm, more particular in the range of about 0.1 to about 0.16 mm or any other numerical range which is narrower and which falls within such broader numerical range, as if such narrower numerical ranges were all expressly written herein. Length of the bristle depends on the intended use. Generally, a bristle filament can be of any suitable length for transporting, such as about 1200 mm and in then cut into pieces of the desired length. Bristles which shall be mounted to a brush by anchor wires have a doubled length compared to the bristles which are mounted to the brush by anchor free techniques. In addition the length of a bristle influences the bending forces needed to bend the bristle. Thus, the length of a bristle can be used to realize different stiffness of bristles in a brush pattern. The typical length of a bristle for brush, in particular a toothbrush, may be in the range from about 5 mm to about 20 mm, in particular in the range from about 7 mm to about 17 mm, more particular in the range of about 8 mm to about 15 mm or any other numerical range which is narrower and which falls within such broader numerical range, as if such narrower numerical ranges were all expressly written herein. The filaments stored in the filament storage container may be longer than the final filament length in the resulting brush head so that the filaments from one storage container can be cut to different specific final length. The filaments in the storage container may be longer than the final filaments in the range from about 0.5 mm to about 7 mm, in particular in the range from about 1 mm to about 5 mm, more particular in the range of about 1.5 mm to about 3 mm or any other numerical range which is narrower and which falls within such broader numerical range, as if such narrower numerical ranges were all expressly written herein.

The storage container may be of any geometrical shape as long as the bristles can be stored therein. The plurality of bristles is arranged in the storage container along their length axis. That means each bristle element is arranged with its length axis in parallel to the adjacent bristles. In addition the bristles are located at a side wall of the storage container with a first end. At the opposite second end of the bristles the storage container does not comprise any border, such as a side wall so that the second end of the bristles is located in the direction of the open side of the storage container. Thereby the second end of the bristles is exposed to the environment. The side wall arranged opposite to the open end of the storage container will be termed "bottom" of the storage container in the description.

"Being exposed to the environment" as used herein shall mean that the ends of the bristles are achievable for the outside. In particular an immersion unit shall be able to be brought into contact with the ends of the bristles. That means the dimension of the storage container may be chosen in that the ends of the bristles exposed to the environment are protruding from the storage container, or are flush with the storage container side walls or may be located inside of the storage container side walls. If the bristles ends protrude from the storage container they may be easy to reach by the immersion unit, but the filaments can be bent during the application from the oil. If the bristle ends are located inside of the storage container, the bristle filaments are supported by the container side walls during the application of the oil. Thereby a better and faster oil application may be achieved and the bristles are not damaged during the oil application proceedings. However the dimension of the immersion unit has to be constructed in that it can enter the storage container in order to contact the bristles stored therein.

In addition, the device further comprises an immersion unit which is suitable to apply oil to a plurality of bristles. Therefore the immersion unit comprises an absorbent which is immersed with the oil to be applied. Suitable oils are synthetic or natural oils which are allowed to come into contact with the human body. For example synthetic oils, in particular silicone oils can be used. A suitable silicone oil may be for example a 35% dimethicone NF emulsion of DOW CORNING (trade name DOW CORNING 365), being a white liquid emulsion containing 35% Dow Cornings 360 medical Fluid. Alternatively, Dow Corning 24 may also be used. The oil is stored in a reservoir, wherein the reservoir and the absorbent are connected via a dosing line. A dosing valve opens and closes the connection between the oil reservoir and the dosing line. Opening and closing of the dosing valve depends on the immersion state of the absorbent. An immersion level sensor monitors the immersion level of the absorbent. If the immersion level of the absorbent reaches a predefined lower threshold the dosing valve is opened and oil is transported via the dosing line into the absorbent. After reaching a predefined upper threshold the dosing valve is closed.

Setting of the lower and the upper threshold depends on the absorbent and the oil used. For example, the upper threshold may be defined as the maximum absorbing capacity. The "maximum absorbing capacity" as used herein may be the maximum amount of oil absorbed in the absorbent without any oil seeping out of the absorbent by gravity. The "minimal lower threshold" as used herein may be defined as the amount of oil transferred to the bristles in one transfer step plus the amount of oil remaining minimally in the absorbent under the transfer conditions. Higher lower thresholds may be used in the method as disclosed herein in order to increase process stability. For example, the lower threshold may be defined as the amount of oil transferred to the bristles in more than one, for example 1.5 or 2, transfer steps plus the amount of oil remaining in the absorbent under the transfer condition. Suitable lower thresholds may be even higher and may be also defined on the base of the absorbent geometric dimension. For example, a suitable lower threshold may be an immersion level of the absorbent which is quarter, a third or half of the thickness of the absorbent measured from the contact surface. Alternatively, no lower threshold may be used and the dosing valve is controlled based on the upper threshold. Suitable immersion level sensors are known in the prior art. Monitoring of the immersion level may be performed continuously or periodically. Periodical monitoring may be based on a time scheme. That means, the immersion level is monitored every x seconds, wherein x may be in the range from about 0.2 to about 10, in particular in the range from about 1 to about 7 sec more particular in the range from about 1.5 to about 5 secs or any other numerical range which is narrower and which falls within such broader numerical range, as if such narrower numerical ranges were all expressly written herein. In addition or alternatively, the immersion level is monitored dependent on the transfer process, e.g. after every transfer step or after every second transfer step or after every third transfer step.

In addition or alternatively, the device may comprise at least an absorbent suitable to absorb the oil and transfer it to the bristles. Said transfer of the oil may be performed by contacting the absorbent with the second ends of the bristle provided by the storage container for a predefined period of time with a predefined contact pressure. Thereby the oil may be transferred by gravity and/or by capillary forces.

In order to bring the absorbent into contact with the second ends of the bristles as mentioned above the absorbent may be mounted onto a movable arrangement unit. Said movable arrangement unit has to be able to bring the absorber into contact with the bristle ends and to end the contact after a predefined period of time. A suitable movable arrangement unit may be an absorbent carrier being coupled to a hydraulically moved piston so that the absorbent is oriented towards the ends of the plurality of bristles. The piston moves the absorbent in the direction of the bristle ends at least until the surface of the absorbent contacts the bristle ends. In addition, the absorbent may apply pressure to the bristles ends in order to transfer the oil, wherein the application of pressure is advantageous per se. For example the bristles may be pressed against the bottom of the storage container during the application of the oil so that all bristles are arranged at the same position inside the storage container. Said improvement of the arrangement of the bristles may make the picking process easier thereby improving process quality and stability. After the application of the oil has finished the piston may draw back the absorbent from the bristle ends and the storage container. The piston should be movable in such that the maximal distance between the bristle ends and the absorbent is sufficient enough to replace the storage container.

As already described the bristles shall be provided in a storage container before they are immersed with the oil. However, bristles are not manufactured as bristles of a pre-defined length, but as a continuous filament strand which is provided in roles or in large pieces of such strand. For example, bristle filament strands are available as hanks. A bristle hank is an arrangement of a plurality, namely about 120000, bristle filaments which are all arranged with parallel length axis. The length of the hank may be determined by handling requirements as longer hanks are handles more difficultly and from shorter hanks less bristles can be achieved. The diameter of a hank is defined by the diameter and number of the bristles forming one hank. For example, a suitable hank may have a length of about 1200 mm and a diameter of about 55 mm. The outer surface of the hank may be covered with an envelope, such as a plastic sheet. From the hank slices of a predefined length can be cut. One of these slices is called a puk and comprises bristles in a predefined length. Said predefined length is at least the length of the longest bristles arranged in the final brush plus the length of the bristles incorporated into the brush head. In addition or alternatively, the puk may also comprise the doubled length of the bristles for anchor based tufting or the length may be slightly larger than the length needed for the longest bristle for amendments of the bristle ends, such as cutting, end-rounding, splicing, tapering etc. A suitable thickness of a puk, corresponding to the length of the individual bristles provided therein may be about 16 mm for bristles to be used in anchor free brushes. From the hank several puks having all the same length are cut and may be provided to pre-treatment. Then the bristles of several puks are arranged in the storage container as a continuous bristle field and the storage container is arranged in the immersion unit.

After applying the oil to the bristles in the storage container the storage container is either transferred to the separation unit and/or transportation unit or the absorbent is removed from the immersion unit in order to be replaced with the separation unit and/or the transportation unit. That means, the device as disclosed herein further comprises a separation unit and a transportation unit.

The separation unit is able to separate a predefined number of bristles from the storage container. For example mechanical separation may be used for example by a picking mechanism. "Picking" as understood herein shall include all possible mechanical methods for separating individual bristles from the bristle storage. For example the predefined number of bristles may be grabbed actively by a grab or bristles may be pushed perpendicular to their length axis continuously from the storage container in the direction of a passive picker having a recess able to accept a predefined number of bristles. Picker units are known by the skilled person e.g. from WO2011/128020A1. The picked number of bristles, named bristle tuft, are then provided to the transportation unit which is suitable to transfer the separated bristles to a pre-defined space. Alternatively, the bristles may be directly sucked from the storage container by the transportation unit to form a bristle tuft. Two or more initially separated bristle tufts may be combined later on in the arranging unit.

The transportation unit comprises at least one tube and a device for producing an airflow inside the at least one tube. The end of the tube arranged adjacent to the separated bristles may comprise one nozzle which is connected to the tube. The nozzle may have the same diameter than the tube or the nozzle may be a funnel. More than one nozzle-tube combination may be used in parallel in the transportation unit as disclosed herein. Inside the tubes an airflow shall be produced in order to transport the separated bristle tufts by said airflow. Therefore, the tubes are connected for example to a sucking unit so that the bristles are separated by underpressure. That means, the bristles can be sucked from the separation unit or the storage container into the nozzle and may be then trasnported via underpressure from the end of the tube comprising the nozzle to the other end of the tube.

Said second end of the tube may be connected to any suitable space to receive the bristles for further prosecution. For example, the second end of the tube may be connected to an arranging unit which may be also part of the device as disclosed herein. The arranging unit may be any unit or device able to arrange the bristle tufts being delivered by the tubes in a predefined pattern. Suitable arranging units are for example splitter, funnels, tubes and sliding elements or combinations thereof, wherein the bristle tufts are transferred from one funnel or tube to another one. The movement of the bristle tufts in the arranging unit may be the already applied airflow or the bristles may be moved by sliding elements. In the arranging unit the final size, shape and length of the bristle tuft is formed and may be amended compared to the bristle tuft being delivered from the tubes of the transportation unit. In addition, the arranging unit might be able to arrange several finalized bristle tufts in a predefined tuft pattern.

Said predefined pattern may be transferred to a providing unit which is also part of the device as disclosed herein. The providing unit is able to provide the predefined bristle tuft pattern to a brush forming unit which forms the final brush. For example, the brush forming unit may be an injection molding machine. Therein the ends of the bristles tufts which protrude from the providing unit can be over-molded thereby forming a brush head or a part thereof. Said brush head may be mounted to a brush handle or the brush handle may be formed in a second injection molding step by over-molding the brush head or the part thereof. Suitable providing units may be for example parts of a mold for the injection molding machine. For example, a part of a mold used as providing unit may be a mold part comprising holes adapted to receive a bristle tuft. In particular, a plurality of holes may be arranged in the mold part in a pre-defined pattern corresponding to the bristle tuft pattern of the brush head to be formed. Said mold parts, called mold bars herein, may comprise more than one hole-pattern so that more than one brush can be formed in parallel.

In the following, a detailed description of several example embodiments will be given. It is noted that all features described in the present disclosure, whether they are disclosed in the previous description of more general embodiments or in the following description of example embodiments of the devices, even though they may be described in the context of a particular embodiment, are of course meant to be disclosed as individual features that can be combined with all other disclosed features as long as this would not contradict the gist and scope of the present disclosure. In particular, all features disclosed for either one of the device or a part thereof or the method of providing bristles for automated (tooth)brush production or steps thereof may also be combined with and/or applied to the other parts of the device or other method steps, if applicable.

FIG. 1 shows a schematic view of the immersion unit 10. The immersion unit 10 as disclosed herein is suitable to apply oil 14 to a plurality of bristles 30. Therefore the immersion unit 10 comprises an absorbent 12 which is immersed with the oil 14. Suitable oils 14 are synthetic or natural oils which are allowed to come into contact with the human body, such as synthetic oils, in particular silicone oils. A suitable silicone oil 14 may be for example a 35% dimethicone NF emulsion of DOW CORNING (trade name DOW CORNING 365). The oil 14 is stored in a reservoir 16, wherein the reservoir 16 and the absorbent 12 are connected via a dosing line 18. A dosing valve 20 opens and closes the connection between the oil reservoir 16 and the dosing line 18. Opening and closing of the dosing valve 20 depends on the immersion state of the absorbent 12, wherein an immersion level sensor 22 monitors the immersion level of the absorbent 12. If the immersion level of the absorbent reaches a predefined lower threshold the dosing valve 20 is opened and oil 14 is transported via the dosing line 18 into the absorbent 12. After reaching a predefined upper threshold the dosing valve 20 is closed. A suitable upper threshold is the maximum absorbing capacity and a suitable lower threshold is an immersion level of the absorbent which is quarter of the thickness of the absorbent measured from the contact surface.

The plurality of bristles 30 is stored in a storage container 36. Bristles 30 may be for example monofilaments made from plastic material such as polyamide (PA), in particular PA 6.10 or PA 6.12. The diameter of the bristle filament may be in the range from about 0.1 to about 0.16 mm or and the bristles may be cut into pieces of a length in the range of about 0.8 to about 1.5 mm.

The storage container 36 may be of any geometrical shape as long as the bristles 30 can be stored therein. The plurality of bristles 30 is arranged in the storage container 36 in such that their length axes are parallel to each other. At a first end 32 of the bristles 30 the bristles 30 are located at the bottom of the storage container 36 and at the opposite (second) end 34 of the bristles 30 the storage container 36 is open, i.e. it does not comprise a side wall, so that the second ends 34 of the bristles 30 are exposed to the environment and can be contacted by an absorbent (26) suitable to absorb the oil 14 and transfer it to the bristles 30. Said transfer of the oil 14 may be performed by contacting the absorbent 26 with the second ends 34 of the bristle 30 for a predefined period of time. Thereby the oil may be transferred by gravity and/or by capillary forces. A suitable period of time sufficient to apply the oil 14 to the bristle ends 34 may be in the range of about 1 sec to about 2 sec. Thereby the oil is transferred to a larger amount of bristles 30. For example, oil in a range from about 0.7 g to about 1.2 g may be transferred to about 120000 filaments.

In order to bring the absorbent 26 into contact with the second ends 32 of the bristles 30 the absorbent 26 may be mounted for example onto an absorbent carrier 27 being coupled to a hydraulically moved piston 28. The piston 28 moves the absorbent 26 in the direction of the bristle ends 34 at least until the surface of the absorbent 26 contacts the bristle ends 34. In addition, the piston 28 may apply pressure to the bristles ends 34 in order to press the bristles ends 34 against the bottom of the storage container 36 during the application of the oil 14 so that all bristles 30 are arranged at the same position inside the storage container 36. After the application of the oil 14 has finished the piston 28 may draw back the absorbent 26 from the bristle ends 34 and the storage container 36.

Figure 2:
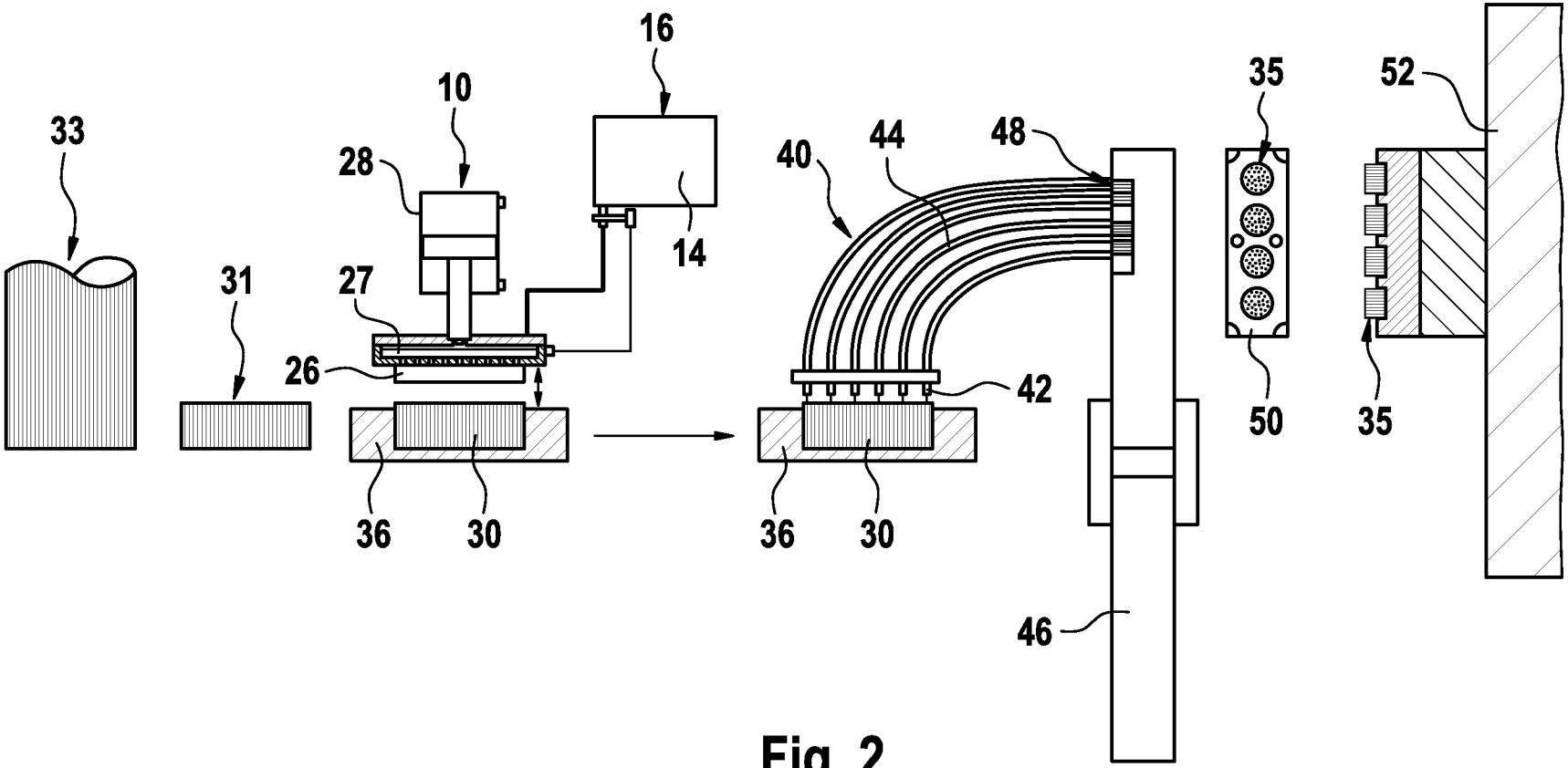
FIG. 2 shows a schematic sketch of an arrangement of devices for providing bristles 30 for the automated production of brushes comprising at least an immersion unit 10.

FIG. 2 shows schematically an automated bristle providing device arrangement comprising an immersion unit 10 as shown in FIG. 1 and at least a transportation unit 40 using airflow for transportation. All features disclosed in FIG. 1, whether described individually or in combination are also applicable to the immersion unit 10 shown in FIG. 2. Features that are in common with the immersion unit 10 shown in FIG. 1 are designated with the same reference numerals and are not described in detail again.

For application of the oil 14 the bristles 30 have to be provided in a storage container 36. Therefore puks 31 are cut from a bristle hank 33. A bristle hank 33 may be an arrangement of a plurality of bristle filaments which are all arranged with parallel length axis. From the hank 33 slices, namely puks 32, are cut which comprise of a predefined thickness corresponding to the length of the bristles 30 comprised in the puk 31. For example puks 31 having a thickness of about 16 mm may be cut from the hank 33. Theses puks 31 may be suitable for bristles 30 to be used in anchor free brushes. Then the bristles 30 of several puks 31 are arranged in the storage container 36 and the storage container 36 is arranged in the immersion unit 10.

After applying the oil 14 to the bristles 30 in the storage container 36 the storage container 36 is either transferred to the separation unit and/or to the transportation unit 40 or the absorbent 26 is removed from the immersion unit 10 in order to be replaced with the separation and/or transportation unit 40.

A separation unit which might be introduced between the immersion unit 10 and the transportation unit 40 (not shown) is able to separate a predefined number of bristles 30 from the storage container 36, for example by mechanical picking. The picked number of bristles 30, named bristle tuft 35, is then provided to the transportation unit 40 in order to be transferred to the arranging unit 48.

The transportation unit 40 comprises at least one nozzle 42 which is connected to one tube 44 of the transportation unit 40. More than one nozzle-tube combination 42, 44 may be used in parallel. The tubes 44 are connected to a sucking unit 46. That means, the bristles 30 can be sucked from the separation unit or the storage container 36 and can be transported via underpressure from the end of the tube 44 comprising the nozzle 42 to the end of the tube 44 being connected to the arranging unit 48. The arranging unit 48 may be any unit able to arrange the bristle tufts 35 being delivered by the tubes 44 in a predefined pattern. Suitable arranging units 48 comprise for example splitter, funnels, tubes, sliding elements or combinations thereof, wherein the bristle tufts 35 are transferred from one element to another element thereby amending shape and size. In addition, the arranging unit 48 is able to arrange several bristle tufts 35 in a predefined pattern of bristle tufts 35 which can be delivered to a providing unit 50.

Suitable providing units 50 may be for example parts of a mold for injection molding, such as mold bars comprising a pre-defined pattern of holes adapted to receive a bristle tuft 35 pattern. Mold bars 50 filled with bristle tufts 35 are introduced into a brush forming unit 52, such as a molding machine. In the molding machine 52 the ends of the bristles tuft 35 which protrude from the providing unit 50 can be over-molded whereby a brush head is formed.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of automated production of brushes for toothbrushes or parts thereof, comprising:

(a) providing a plurality of bristles in a storage container;

(b) applying oil to at least a part of the plurality of bristles in the storage container, wherein the step of applying the oil comprises providing an absorbent, immersing the absorbent with the oil, and contacting at least a part of the plurality of bristles with the immersed absorbent thereby transferring oil from the absorbent to the bristles;

(c) separating two or more bristles from the part of the plurality of bristles to which the oil was applied in order to form a bristle tuft;

(d) transporting at least one of the separated bristle tufts in a tube using an airflow; and (e) arranging the at least one bristle tuft in a bristle pattern of the brush to be produced.

2. The method according to claim 1, wherein the oil is applied to the bristles along the bristles' longitudinal axis.

3. The method according to claim 1, wherein the oil is applied by using at least one of gravity and capillary force.

4. The method according to claim 1, wherein additives signaling substances or abrasives are added to the oil before the oil is applied to the bristles.

5. The method according to claim 1, wherein the oil is selected from the group consisting of technical oil, mineral oil, silicone oil, and any combination thereof.

6. The method according to claim 1, wherein the bristles are pre-treated in a drying oven or microwave before the oil is applied.

7. The method according to claim 6, wherein the bristles are pre-treated in a microwave in a range of from 500 W to 800 W.

8. The method according to claim 1, wherein the airflow is produced by blowing or vacuuming.

9. The method according to claim 1, wherein the bristles are end-rounded at a first end and the oil is applied at a second end of the bristles, the second end being opposite to the first end.

* * * * *